US007870906B2

(12) United States Patent
Ali

(10) Patent No.: US 7,870,906 B2
(45) Date of Patent: Jan. 18, 2011

(54) FLOW CONTROL SYSTEMS AND METHODS

(75) Inventor: Mohammad Athar Ali, Al-Khobar (SA)

(73) Assignee: Schlumberger Technology Corporation, Sugar Land, TX (US)

( * ) Notice: Subject to any disclaimer, the term of this patent is extended or adjusted under 35 U.S.C. 154(b) by 60 days.

(21) Appl. No.: 12/207,251

(22) Filed: Sep. 9, 2008

(65) Prior Publication Data

US 2009/0078428 A1 Mar. 26, 2009

Related U.S. Application Data

(60) Provisional application No. 60/975,031, filed on Sep. 25, 2007.

(51) Int. Cl.
*E21B 34/00* (2006.01)

(52) U.S. Cl. ..... 166/320

(58) Field of Classification Search ..... 166/320, 166/321, 325, 373, 374, 386
See application file for complete search history.

(56) References Cited

U.S. PATENT DOCUMENTS

| | | | | |
|---|---|---|---|---|
| 5,141,062 | A * | 8/1992 | Anderson | 175/234 |
| 5,265,643 | A | 11/1993 | Golestan et al. | |
| 5,383,489 | A | 1/1995 | Golestan et al. | |
| 5,383,498 | A | 1/1995 | Mattern et al. | |
| 5,529,090 | A | 6/1996 | Golestan et al. | |
| 6,039,074 | A | 3/2000 | Raaijmakers et al. | |
| 6,196,259 | B1 | 3/2001 | Weber | |
| 6,250,602 | B1 | 6/2001 | Jansen | |
| 6,352,119 | B1 | 3/2002 | Patel | |
| 6,568,473 | B2 | 5/2003 | de Almeida | |
| 7,296,633 | B2 * | 11/2007 | Bode et al. | 166/386 |
| 2003/0106588 | A1 | 6/2003 | Zahe | |
| 2006/0175052 | A1 | 8/2006 | Tips | |
| 2006/0290037 | A1 * | 12/2006 | Born et al. | 267/120 |
| 2007/0193752 | A1 | 8/2007 | Kim | |
| 2007/0256840 | A1 | 11/2007 | Aakre | |
| 2009/0078428 | A1 | 3/2009 | Ali | |
| 2009/0211769 | A1 | 8/2009 | Assal | |
| 2009/0218103 | A1 | 9/2009 | Aakre et al. | |

FOREIGN PATENT DOCUMENTS

| | | |
|---|---|---|
| NO | 321438 B1 | 5/2006 |
| NO | 20082109 | 5/2008 |

(Continued)

OTHER PUBLICATIONS

Bernt S. Aadnoy, PhD. and Geir Hareland in "Analysis of Inflow Control Devices," Society of Petroleum Engineers, 2009, pp. 1-9.

*Primary Examiner*—William P Neuder
*Assistant Examiner*—Catherine Loikith
(74) *Attorney, Agent, or Firm*—Edmonds & Nolte PC; David G. Matthews; Kevin B. McGoff

(57) ABSTRACT

Disclosed herein is a device for controlling flow within, e.g., a production well or an injection well. The device consists of a movable flow passage and a stationary variable choke or valve that is sensitive to flow parameters and automatically adjusts itself to provide a predetermined flow rate through the device.

13 Claims, 3 Drawing Sheets

FOREIGN PATENT DOCUMENTS

| | | | |
|---|---|---|---|
| WO | 2005/080750 | A1 | 9/2005 |
| WO | 2008/143522 | A1 | 11/2008 |
| WO | 2009/042391 | A1 | 4/2009 |
| WO | 2009/088292 | A1 | 7/2009 |
| WO | 2009/088293 | A1 | 7/2009 |
| WO | 2009/113870 | A2 | 9/2009 |
| WO | 2009/113872 | A2 | 9/2009 |
| WO | 2009/123472 | A2 | 10/2009 |
| WO | 2009/139796 | A1 | 11/2009 |

* cited by examiner

FLOW CONTROL SYSTEMS AND METHODS

REFERENCE TO RELATED APPLICATIONS

This application claims priority to U.S. provisional application Ser. No. 60/975,031 filed on Sep. 25, 2007, incorporated herein by reference.

BACKGROUND

Horizontal well technology is being used today on a worldwide basis to improve hydrocarbon recovery. Such technology may comprise methods and apparatus which increase the reservoir drainage area, which delay water and gas coning and which increase production rate. A problem which may exist in longer, highly-deviated and horizontal wells is non-uniform flow profiles along the length of the horizontal section. This problem may arise because of non-uniform drawdown applied to the reservoir along the length of the horizontal section and because of variations in reservoir pressure, permeability, and mobility of fluids. This non-uniform flow profile may cause numerous problems, e.g., premature water or gas breakthrough and screen plugging and erosion (in sand control wells), and may severely diminish well life and profitability.

In horizontal injection wells, the same phenomenon applied in reverse may result in uneven distribution of injection fluids leaving parts of the reservoir un-swept and resulting in loss of recoverable hydrocarbons.

Reservoir pressure variations and pressure drop inside the wellbore may cause fluids to be produced (in producer wells) or injected (in injector wells) at non-uniform rates. This may be especially problematic in long horizontal wells where pressure drop along the horizontal section of the wellbore causes maximum pressure drop at the heel of the well causing the heel to produce or accept injection fluid at a higher rate than at the toe of the well. This may cause uneven sweep in injector wells and undesirable early water breakthrough in producer wells. Pressure variations along the reservoir make it even more difficult to achieve an even production/injection profile along the whole zone of interest.

Various methods are available, which are directed to achieving uniform production/injection across the whole length of the wellbore. These methods range from simple techniques like selective perforating to sophisticated intelligent completions which use downhole flow control valves and pressure/temperature measurements that allow one to control drawdown and flow rate from various sections of the wellbore.

Another available method is to place pre-set fixed nozzles or some other means of providing a pressure drop between reservoir and production tubing. Such a nozzle may comprise a choke or valve that restricts the flow rate through the system. the pressure drop caused by these nozzles varies in different parts of the wellbore depending upon the reservoir characteristics to achieve even flow rate along the length of the well bore.

While intelligent completion methods may result in acceptable control of drawdown and flow, such methods require hydraulic and/or electric control lines which limit the application of such methods and which add to the overall cost of the completion. On the other hand, pre-set pressure drop techniques (i.e., pre-set fixed nozzles) are completely passive, have a limited control on the actual flow rate through them, and have no ability to adjust the choke size after the completion is in place. By design, these fixed flow area pressure drop device techniques require uneven flow rate through them to vary the pressure drop across them.

In addition, it has been observed during production logging of wells completed with such passive devices that under certain flow conditions, fluids may cross flow from one section of the wellbore to another, because these devices provide no means to prevent flow of fluids from high to low pressure regions of the reservoir.

SUMMARY

Flow control apparatus disclosed herein comprise a variable choke or valve that is sensitive to flow parameters and automatically adjusts itself to provide a predetermined flow rate through the device. Flow control devices may be utilized in the flow path from the reservoir to the wellbore along the length of the well and help to create a predetermined production or injection profile by automatically adjusting the flow area and the pressure drop through the flow stabilizers.

In some embodiments, the flow control apparatus maintains a constant flow rate through the choke or valve by automatically adjusting the area of the flow in response to changes in pressure drop ($\Delta p$) across the apparatus caused either by the upstream and/or downstream pressure.

Accordingly, in response to an increase in upstream pressure, a flow control apparatus in accordance with some embodiments disclosed herein functions to reduce its flow area by moving the flow tube towards a closed position thereby reducing the flow. Similarly, in response to an increase in downstream pressure, a flow control apparatus in accordance with some embodiments disclosed herein functions to increase its flow area by moving the flow tube to an open position thereby increasing the flow.

In some embodiments, various configurations of the apparatus can allow varying sensitivity to upstream and downstream pressures.

In order to avoid reverse flow through the apparatus, it may also be configured to also act as a check valve, e.g., to ensure no cross flow occurs between different parts of the wellbore.

DETAILED DESCRIPTION

It will be appreciated that the present invention may take many forms and embodiments. In the following description, some embodiments of the invention are described and numerous details are set forth to provide an understanding of the present invention. Those skilled in the art will appreciate, however, that the present invention may be practiced without those details and that numerous variations and modifications from the described embodiments may be possible. The following description is thus intended to illustrate and not to limit the present invention.

Figure 1:
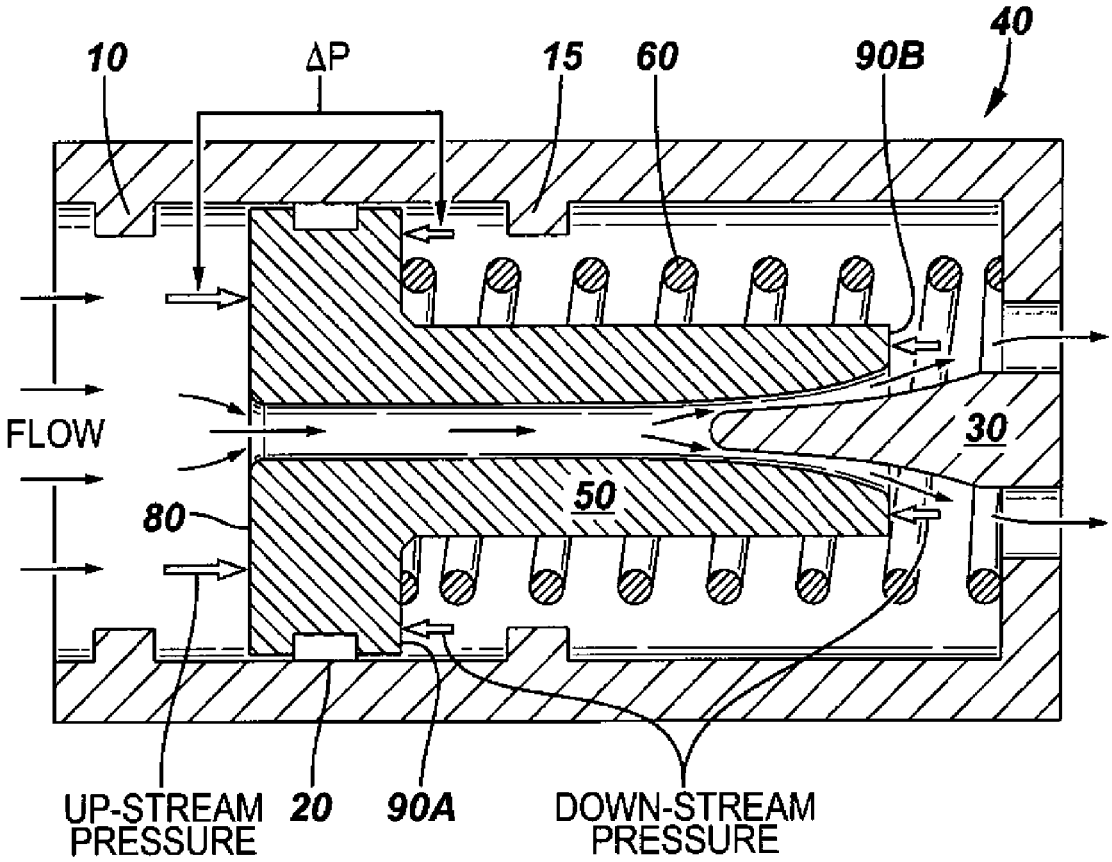
FIG. 1 is a schematic side view in partial cross-section of a flow control apparatus in accordance with one embodiment of the present invention.

Referring first to FIG. 1, flow control apparatus 40 is shown having a movable flow passage 50, a stationary variable choke 30, spring 60, upstream no-go elements 10, downstream no-go elements 15, and sealing elements 20.

In operation, flow control apparatus 40 uses the difference between upstream and downstream pressures across the device to automatically adjust the flow area, and therefore back pressure and flow rate, through the device. For example, flow control device 40 may be installed in a production well or an injection well to control the flow coming from or going to a particular zone of the well. In a production well, production fluid (e.g., oil) flows through flow passage 50 as well as exerts pressure onto the upstream surface 80 of flow passage 50. The pressure across the upstream surface 80 translates to a force which moves the flow passage 50 in the upstream direction. The movement in the upstream direction engages the spring 60 which then exerts a force in the downstream direction. In addition, downstream pressure exerts a force on downstream surfaces 90A and 90B which also counteract the force on the upstream surface 80. For any given flow rate, the force on the upstream surface 80 and the sum of the forces on the downstream surfaces 90A and 90B and the force of the spring will reach an equilibrium by moving the flow passage 50 towards the variable choke 30 which restricts the flow passage thereby restricting the flow through the flow passage. Upstream and downstream no-go elements 10 and 15 restrict the amount that flow passage 50 may move towards and away from stationary variable choke 30. Seal 20 (e.g., an o-ring) seals the annulus between the flow passage 50 and housing in which it sits to prevent fluid communication between the upstream and downstream sides of the apparatus 40.

If upstream pressure is relatively low, the equilibrium position will be that the flow passage 50 will be farther away from the stationary variable choke 30 which will allow greater flow through flow passage 50. In contrast, if upstream pressure is relatively high, the equilibrium position will be that the flow passage 50 will be closer to the stationary variable choke 30 which will restrict flow through flow passage 50. In operation, many variables may be adjusted to control the equilibrium conditions of the apparatus 40. For example, the tension of the spring 60 may be adjusted. A relatively higher tension spring will tend to have a relatively higher equilibrium flow rate than a relatively lower tension spring. In addition, other variables may be adjusted, such as, by way of example only, the surface area available to the upstream and downstream pressures, the shape of the stationary variable choke, and the position of the no-go elements.

It will be understood by one of ordinary skill in the art that spring 60 may take the form of any device that provides a resistance against movement, by way of non-limiting example only, a piston assembly inside of a gas chamber. Flow control apparatus 40 may comprise a mechanical and/or gas (e.g., $N_2$) spring which acts against the force applied due to differential pressure across the flow passage 50 and moves the flow passage 50 over stationary variable choke 30. The shape of the choke 30 and the internal profile of the flow passage 50 are designed to vary the flow area as the flow passage 50 slides over or away from the choke 30. The shape of the choke 30 may be any of a number of shapes, including, by way of example only, conical, frustoconical, or semi-spherical.

The choke 30 may be designed such that when the choke 30 is completely seated in the corresponding end of the flow passage 50 that it completely shuts off flow. Alternatively, it may be designed such that when it is seated it does not completely shut off flow through flow passage 50. The device may also be configured such that no-go elements 15 are positioned such that flow passage 50 is unable to completely seat in choke 30.

Figure 2:
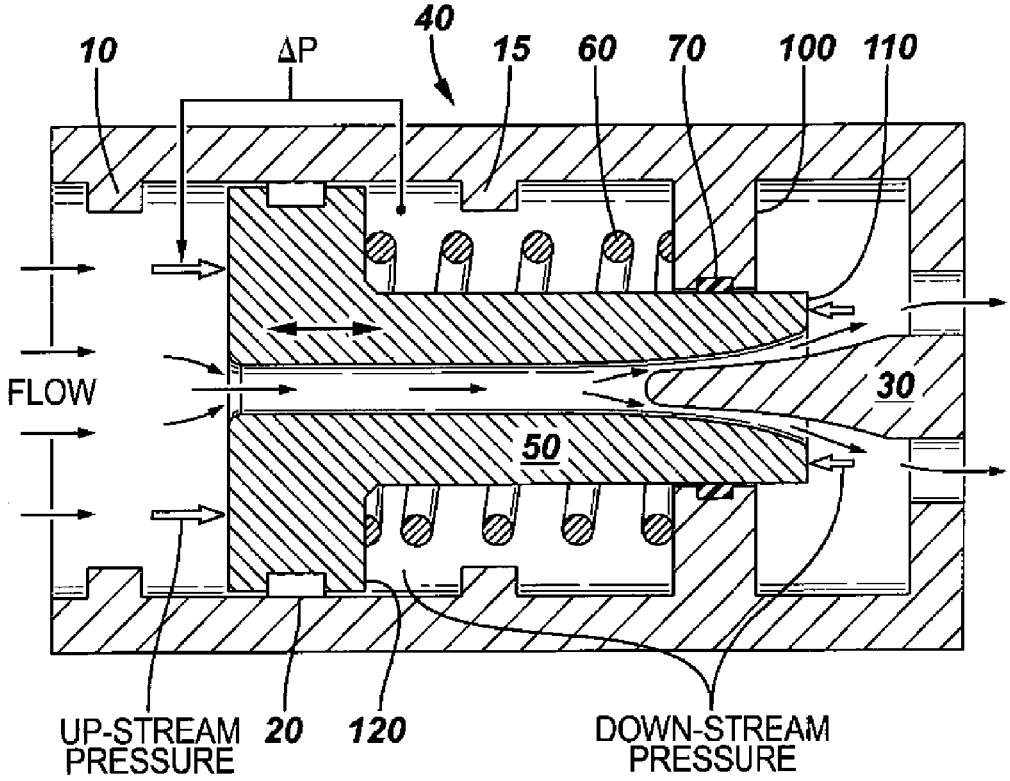
FIG. 2 is a schematic side view in partial cross-section of a flow control apparatus in accordance with one embodiment of the present invention.

Referring now to FIG. 2, in another embodiment of a flow control device 40, a flow control device 40 is shown which is more sensitive to the upstream pressure than the downstream pressure by isolating major part of the area on which downstream pressure is acting. The embodiment shown in FIG. 2 operates similar to the embodiment shown in FIG. 1. However, the embodiment of FIG. 2 restricts the area on which the downstream pressure will act. Particularly, in FIG. 2, the downstream pressure will act on downstream lip 110. Pressure isolating element 100 isolates the other downstream surfaces (e.g., isolated downstream surface 120) from the downstream pressure. A seal 70 (e.g., an o-ring) prevents the downstream pressure from acting on isolated downstream surface 120. Thus, because the surface area upon which the downstream pressure can act is limited, the force that the downstream pressure imparts on the flow passage 50 is reduced. Consequently, the device will be more sensitive to changes in upstream pressure than a device in which more of the downstream surface area is exposed to the downstream pressure.

The force of spring 60 and the allowable movement of flow passage 50 (e.g., between the no-go elements 10 and 15) can be adjusted for any given application to provide a minimum and maximum allowable flow area and therefore a variable pressure drop across the device. The device can also be configured so that at a defined/designed minimum upstream flowing pressure it fully closes and acts as a safety device in case of uncontrolled flow of the well.

Figure 3:
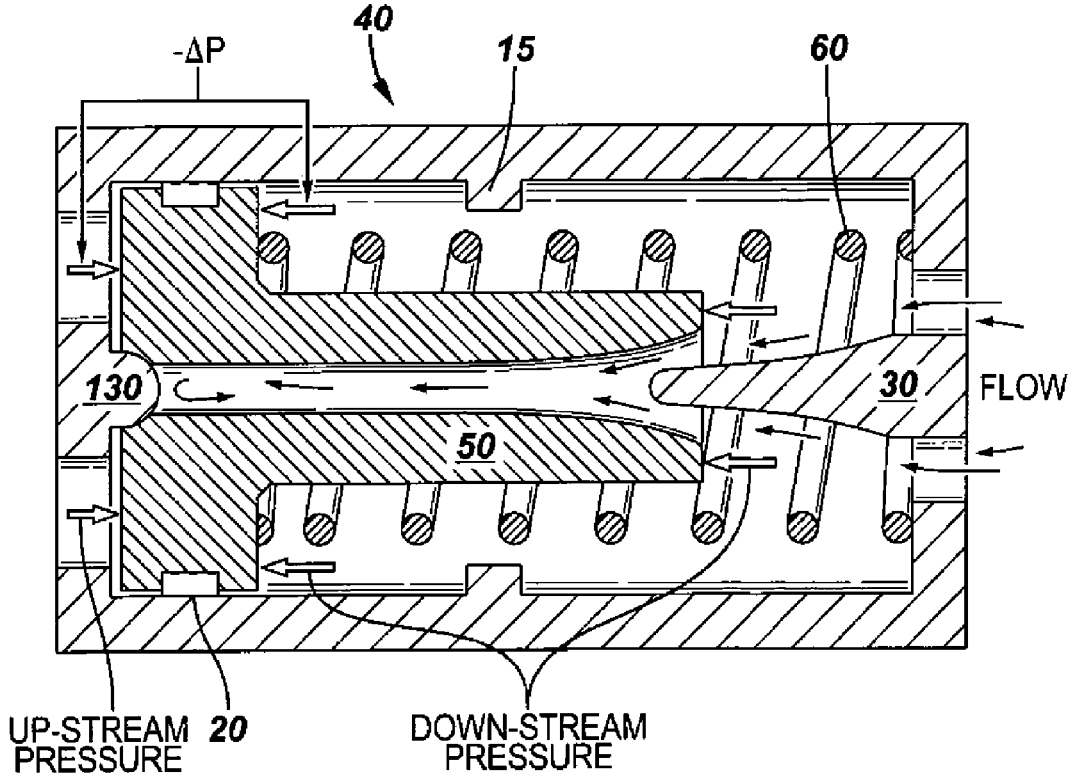
FIG. 3 is a schematic side view in partial cross-section of a flow control apparatus in accordance with one embodiment of the present invention.

Referring now to FIG. 3, flow control device 40 can be configured such that flow passage 50 also acts as a check valve to positively eliminate reverse flow through the device. The check valve function can be achieved without substantially affecting the pressure drop/flow rate stabilization function of the device by incorporating a plug 130 which closes the flow passage 50. Any flow through the flow control device 40 in the reverse direction (i.e., from downstream to upstream) will require the downstream pressure to be higher than upstream pressure. This will cause the flow passage 50 to move and stop against the plug 130 and stop any flow in reverse direction through the device.

Figure 4:
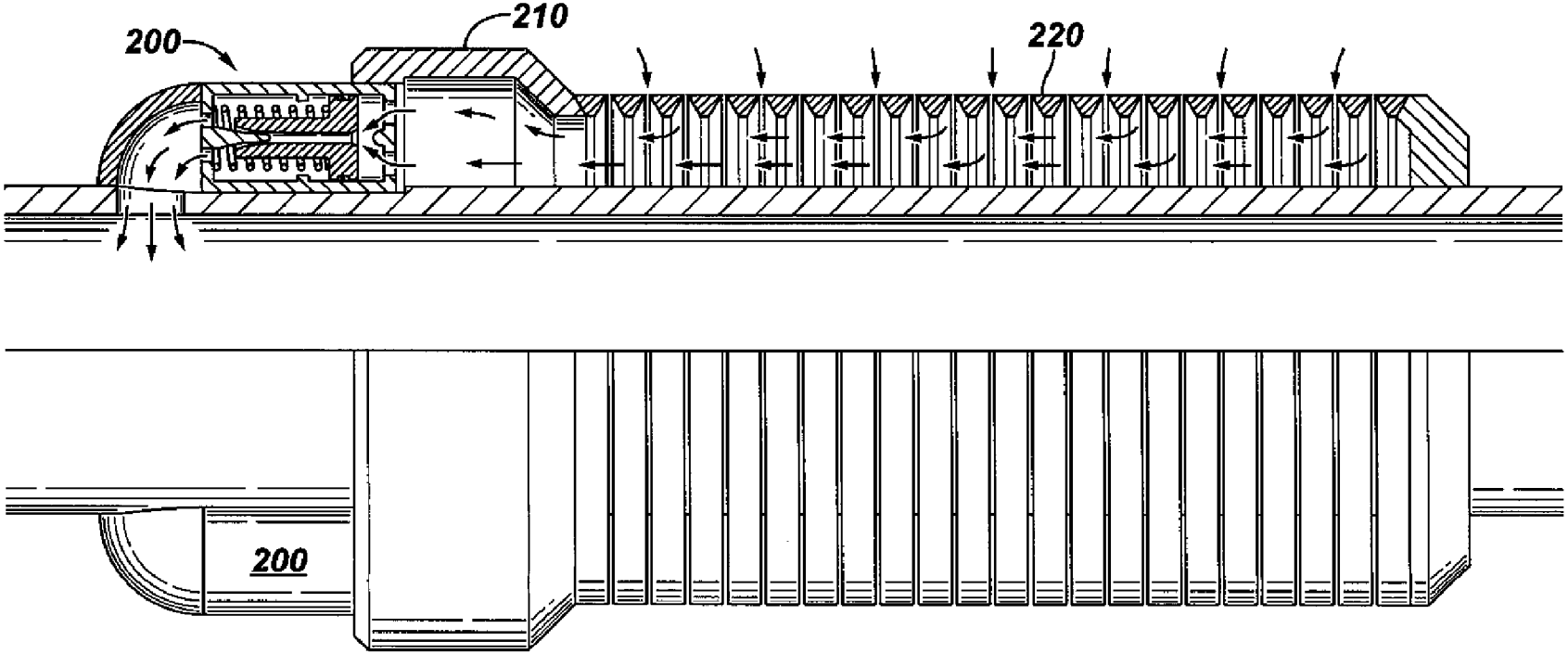
FIG. 4 is a schematic side view in partial cross-section of a flow control apparatus coupled to an illustrative flow control device in accordance with one embodiment of the present invention.

When a series of flow control devices 40 are placed in different parts of a producer well isolated with zonal isolation devices (e.g., packers), each flow control device 40 will automatically adjust its flow area to account for variations in tubing (downstream) pressure and/or the reservoir (upstream) pressure by moving the flow passage 50 over the stem 130 to stabilize and provide even flow from different sections of the wellbore/reservoir. As is shown in FIG. 4, one or more flow control devices 200 can be configured around the tubing adjacent a manifold 210 with or without a filter medium 220 such that all flow from the reservoir is directed into the tubing through the inflow control devices. Similarly in an injector well the ICDs are installed such that all injection fluids are directed from the tubing to the reservoir through the ICDs to provide even distribution of the fluid along the length of the wellbore.

Similarly the flow control device 40 may be used in reverse for injection wells, to stabilize and provide even injection into different sections of the wellbore/reservoir.

What is claimed is:

1. A well flow control apparatus, comprising:

a movable flow passage within a well, wherein the movable flow passage comprises an upstream end having a first surface area and a downstream end having a second surface area, wherein upstream pressure acts on the first surface area to create an upstream force and downstream pressure acts on the second surface to create a downstream force;

a variable choke device to adjust the rate of flow through the movable flow passage, wherein the position of the flow passage relative to the choke is automatically adjusted by the pressure differential across the flow passage;

a device that resists the upstream force; and a backflow preventer wherein when the downstream force is greater than the upstream force, the flow passage closes.

2. The apparatus of claim 1 wherein the backflow preventer is a one-way valve.

3. The apparatus of claim 1 wherein the backflow preventer is a plug positioned upstream of the flow passage.

4. The apparatus of claim 1, wherein the variable choke device is of a shape chosen from the group consisting of conical, frustoconical, and semispherical.

5. The apparatus of claim 1 wherein the device that resists the upstream force is a spring adapted to engage the movable flow passage.

6. An apparatus for regulating a fluid flow, comprising:

a housing having a movable flow passage disposed therein, wherein the movable flow passage has a first surface opposing second and third surfaces;

an annular sealing element disposed on the movable flow passage between the first surface and the second opposing surface and sealingly engaging an inside surface of the housing;

a spring disposed within the housing and biasing the second surface of the movable flow passage in a first direction;

a tapered member affixed to the housing and positioned at least partially within the movable flow passage; and a backflow preventer disposed adjacent the first surface of the movable flow passage and configured to prevent a reverse flow of fluid through the movable flow passage when forces on the second and third surfaces are greater than forces on the first surface.

7. The apparatus of claim 6, wherein the tapered member is configured to autonomously choke the fluid flow through the movable flow passage in response to a pressure differential created between the first surface and the second and third surfaces.

8. The apparatus of claim 7, wherein the tapered member restricts the fluid flow through the movable flow passage when the movable flow passage moves in a second direction.

9. The apparatus of claim 6, further comprising a pressure isolating element defined by the housing and sealingly engaging an outside surface of the movable flow passage between the second and third surfaces.

10. A completion assembly for regulating a flowrate in a horizontal wellbore, comprising:

a production tubular disposed in the horizontal wellbore adjacent a hydrocarbon-bearing formation;

a filter medium disposed about the production tubular;

a flow control apparatus disposed on the production tubular and in fluid communication with the filter medium, the flow control apparatus comprising:

a movable flow passage disposed within a housing and having an upstream surface and first and second downstream surfaces;

a spring configured to engage the first downstream surface and bias the movable flow passage in a first direction, thereby allowing a flow of fluid through the movable flow passage;

a tapered member affixed to the housing and positioned at least partially within the movable flow passage and configured to autonomously choke the flow of fluid through the movable flow passage in response to a pressure differential created between the upstream surface and the first and second downstream surfaces; and a plug disposed adjacent the upstream surface and configured to prevent a reverse flow of fluid through the movable flow passage.

11. The completion assembly of claim 10, wherein the tapered member restricts the flow of fluid through the movable flow passage when the movable flow passage moves in a second direction.

12. The completion assembly of claim 10, wherein the movable flow passage engages the plug when the pressure differential created between the upstream surface and the first and second downstream surfaces forces the movable flow passage in the first direction.

13. The completion assembly of claim 10, wherein two or more flow control apparatus are disposed on the production tubular, each flow control apparatus adapted to regulate flow through different zones of the well.

* * * * *